US007399243B2

(12) United States Patent
Schank et al.

(10) Patent No.: US 7,399,243 B2
(45) Date of Patent: Jul. 15, 2008

(54) SYSTEM AND APPARATUS FOR SUPPORTING A SPORTS BALL NET

(75) Inventors: Timothy Schank, Boone, IA (US); John Trucano, Ottumwa, IA (US); Timothy Mobley, Jefferson, IA (US); Neal C. Squibb, Scranton, IA (US)

(73) Assignee: Russell Corporation, Atlanta, GA (US)

( * ) Notice: Subject to any disclaimer, the term of this patent is extended or adjusted under 35 U.S.C. 154(b) by 272 days.

(21) Appl. No.: 11/431,783

(22) Filed: May 10, 2006

(65) Prior Publication Data

US 2007/0129185 A1 Jun. 7, 2007

Related U.S. Application Data

(60) Provisional application No. 60/741,664, filed on Dec. 2, 2005.

(51) Int. Cl.
*A63B 61/02* (2006.01)

(52) U.S. Cl. ..... 473/492

(58) Field of Classification Search ..... 473/492, 473/493

See application file for complete search history.

(56) References Cited

U.S. PATENT DOCUMENTS 1,459,723 A * 6/1923 Eskell ..... 473/492
3,645,370 A 2/1972 Rodwell et al.
3,860,240 A 1/1975 Koch
3,931,965 A 1/1976 Grant
3,940,139 A 2/1976 Barnes
3,961,789 A 6/1976 Tabacheck
3,996,708 A 12/1976 Frye
4,009,780 A 3/1977 Frye
4,040,214 A * 8/1977 Frye ..... 52/157
4,065,099 A 12/1977 Germain
4,098,041 A 7/1978 Frye
4,109,910 A 8/1978 Gleason
4,122,451 A * 10/1978 Senoh ..... 473/492
4,253,671 A * 3/1981 Pace ..... 473/493
4,372,561 A 2/1983 Morgan et al.
4,440,393 A 4/1984 Smith, Jr.
4,444,397 A * 4/1984 Kaburagi et al. ..... 473/493
4,830,382 A 5/1989 Wheeler
4,844,455 A 7/1989 Funkhouser, Jr.
4,948,150 A 8/1990 Daly, Jr. et al.
4,973,059 A 11/1990 Stewart
4,993,719 A 2/1991 Hernandez
5,020,286 A 6/1991 Hamar et al.

(Continued)

*Primary Examiner*—Raleigh W. Chiu

(57) ABSTRACT

The present disclosure relates to a system and apparatus for supporting a sports ball net, such as a volleyball net. The system includes a first support standard and a second support standard. The first support standard includes a main body, a net tensioning assembly secured to the body, and an adjustable lower support assembly secured to the body for removably securing the first support standard with a first floor support sleeve. A second support standard includes a main body and an adjustable lower support assembly secured to the body for removably securing the second support standard with the second floor support sleeve. The system further includes a net support line removably attached to the tensioning assembly of the first support standard and to the second support standard. The adjustable lower support assembly includes a drive member for driving a slide member, a slide member housing, and at least one expansion member operatively connected to the slide member for engaging the corresponding floor support sleeve.

25 Claims, 15 Drawing Sheets

U.S. PATENT DOCUMENTS

| | | | | | |
|---|---|---|---|---|---|
| 5,156,408 | A | | 10/1992 | Hall | |
| 5,215,310 | A | | 6/1993 | Allbright | |
| 5,238,251 | A | | 8/1993 | Staka | |
| 5,242,174 | A | | 9/1993 | Koole | |
| 5,269,533 | A | | 12/1993 | Kellams | |
| 5,308,085 | A | * | 5/1994 | Koole | 473/493 |
| 5,316,315 | A | | 5/1994 | Roark, Jr. | |
| 5,320,344 | A | | 6/1994 | Henderson | |
| 5,333,880 | A | | 8/1994 | Allbright | |
| 5,344,157 | A | | 9/1994 | McCord | |
| 5,542,679 | A | * | 8/1996 | Caso | 473/175 |
| 5,816,956 | A | | 10/1998 | Ellis et al. | |
| 5,855,527 | A | * | 1/1999 | Koole | 473/493 |
| 5,860,877 | A | | 1/1999 | Esser | |
| 5,951,417 | A | | 9/1999 | Ha | |
| 5,954,308 | A | | 9/1999 | Lane et al. | |
| 6,171,205 | B1 | | 1/2001 | Hummel | |
| 6,224,153 | B1 | | 5/2001 | Vodinh | |
| 6,248,030 | B1 | | 6/2001 | Pierce | |
| 6,461,258 | B1 | | 10/2002 | Vacanti | |
| 6,659,893 | B1 | | 12/2003 | Campbell et al. | |
| 6,800,043 | B1 | | 10/2004 | Pohrer | |
| 6,802,789 | B1 | | 10/2004 | Ishino | |
| 6,852,046 | B1 | * | 2/2005 | Wewel et al. | 473/463 |
| 6,899,187 | B1 | | 5/2005 | McCarthy | |
| D507,618 | S | | 7/2005 | Scarpa, III | |
| 2002/0065153 | A1 | * | 5/2002 | Bertrand | 473/492 |
| 2002/0132686 | A1 | | 9/2002 | Roark, Jr. | |
| 2004/0011839 | A1 | | 1/2004 | Carey | |
| 2005/0059514 | A1 | | 3/2005 | Carey | |
| 2005/0090338 | A1 | | 4/2005 | Scarpa, III | |
| 2006/0073922 | A1 | * | 4/2006 | Stambaugh | 473/492 |
| 2007/0129185 | A1 | * | 6/2007 | Schank et al. | 473/492 |

* cited by examiner

SYSTEM AND APPARATUS FOR SUPPORTING A SPORTS BALL NET

A claim for domestic priority is made herein under 35 U.S.C. §119(e) to U.S. Provisional App. Ser. No. 60/741,664 filed on Dec. 2, 2005, the entire disclosure of which is incorporated herein by reference.

BACKGROUND

The present disclosure relates in various exemplary embodiments, to a system and apparatus for supporting a sports ball net, such as a volleyball net. It includes, but is not limited to, standards or uprights having an adjustable floor support or internal net tensioning assembly. The embodiments find particular application in conjunction with volleyball systems that are designed to be setup and torn down frequently, as for example in a school gymnasium. However, it is to be appreciated that the present exemplary embodiments are also amenable to other like applications.

Over the years, a number of volleyball standard systems have been designed to accomplish the task of rigidly supporting a volleyball net. Traditionally, two upright vertical posts are placed at either end of the volleyball net and secured to the ground. In most cases, the uprights or standards are fabricated from steel tubular material and usually include a means for attaching a volleyball net support line to either upright or standard. In addition, an external winch is usually attached to one standard to allow for tensioning of the support line. Generally, the external winch is a relatively bulky component having a cable take-up spool, a hand crank and a ratcheting mechanism to prevent the spool from unraveling. The external winch mechanism includes several drawbacks. One drawback involves the danger of a player or referee coming into contact with the winch during game play and causing injury to themselves. A further drawback involves the non-aesthetic appeal of an external winch.

Another disadvantage involving traditional uprights or standards involves the method of securing the standard to a floor. One method that has been devised involves the use of a floor sleeve which is recessed into the floor or playing surface and provides an open cavity designed to receive the lower end of the standard. Typically, these sleeves range in diameter from 3 inches to 4 inches. A problem is thus encountered when a mismatch occurs between the diameter of the standard and the floor sleeve. For instance, a 4 inch diameter standard would obviously not fit into a 3 inch diameter floor sleeve. Conversely, a 3 inch diameter standard would fit too loosely in a 4 inch diameter floor sleeve.

This disclosure is directed to overcoming one or more of the aforementioned problems and others.

SUMMARY

According to one aspect of the present disclosure, a system for supporting a sports ball net is provided. The system includes a first support standard having a main body, a net tensioning assembly secured to the body, and an adjustable lower support assembly secured to the body for removably securing the first support standard with a first floor support sleeve. The system also includes a second support standard having a main body and an adjustable lower support assembly secured to the body for removably securing the second support standard with a second floor support sleeve. Furthermore, a net support line having a proximal end and a distal end is provided. The proximal end is removably attached to the tensioning assembly of the first support standard and the distal end is removably attached to the second support standard. The adjustable lower support assembly includes a drive member for driving a slide member. The adjustable lower support assembly also includes a slide member disposed within a slide member housing and at least one expansion member operatively connected to the slide member for engaging the corresponding floor support sleeve.

According to another aspect of the present disclosure, a standard for supporting a sports ball net is provided. The standard includes a housing having a centerline longitudinal axis and a net tensioning assembly disposed substantially internal to the housing. The tensioning assembly includes a tensioning rod, a drive member engaged with the tensioning rod, and a handle for driving the drive member. The handle of the net tensioning assembly is disposed along the centerline longitudinal axis of the housing. The standard further includes a bottom support portion disposed at a lower end of the housing for rigidly securing the standard to an associated playing surface.

According to yet another aspect of the present disclosure, a further standard for supporting a sports ball net is provided. The standard includes a housing and an adjustable floor support assembly. The assembly is disposed at a lower portion of the housing. The assembly includes a drive member for driving a slide member and the slide member is disposed internally to a slide member housing. The slide member housing is secured to the housing of the standard and at least one expansion member is operatively connected to the slide member. The expansion member is adapted to engage an inner wall of a floor support sleeve.

Other benefits and advantages of the embodiments of the present disclosure will become apparent to those of average skill in the art upon a reading of the following detailed specification.

BRIEF DESCRIPTION OF THE DRAWINGS

The system and apparatus of the present disclosure may take form in certain structures and components, several non-limiting embodiments of which will be described in detail in this specification and illustrated in the accompanying drawings. In the drawings.

DETAILED DESCRIPTION

Figure 1:
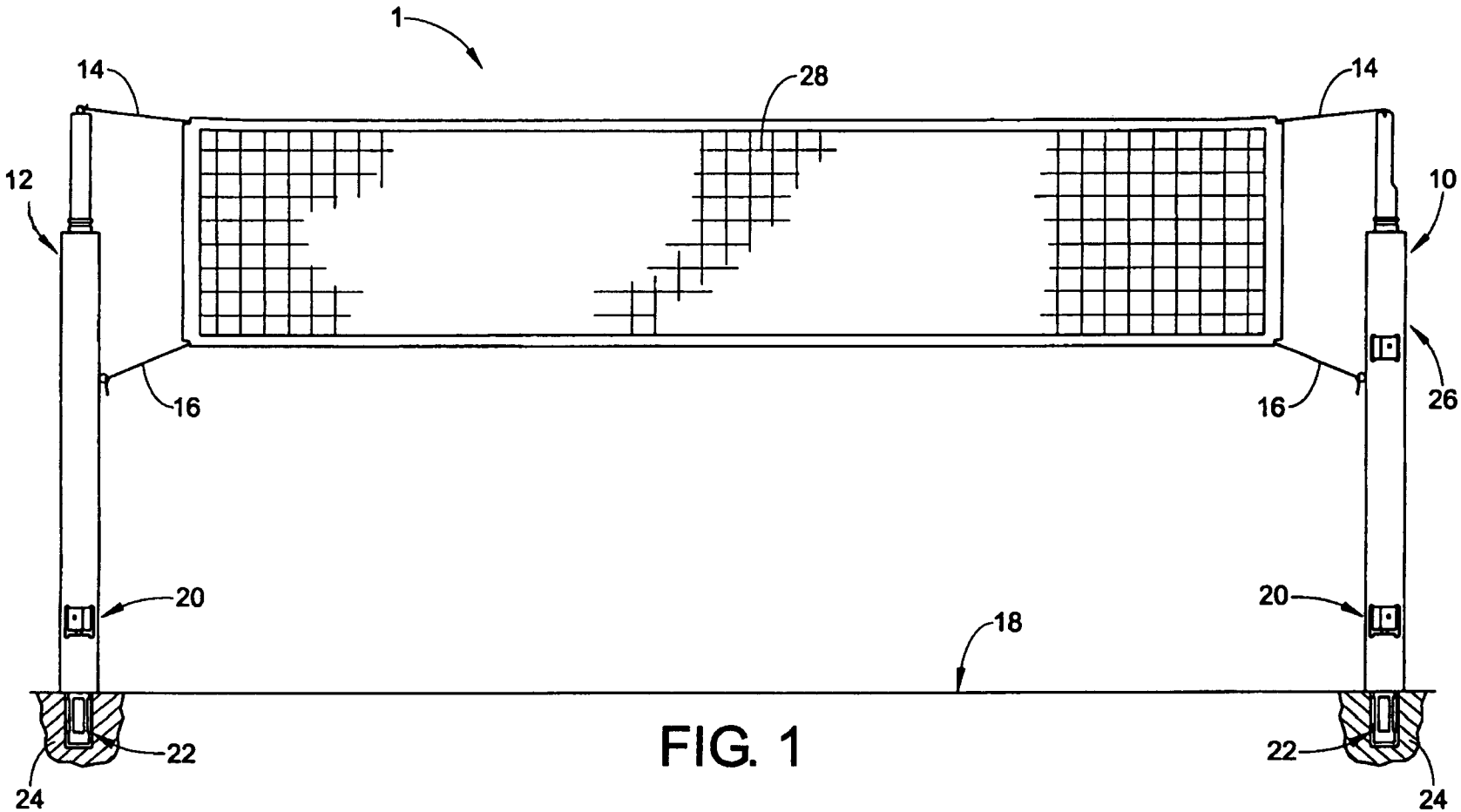
FIG. 1 is a front perspective view of a first embodiment of a system for supporting a sports ball net according to the present disclosure.

The present disclosure relates to a system and apparatus for supporting a sports ball net, such as a volleyball net. The system includes a first support standard and a second support standard. The first support standard includes a main body or housing, a net tensioning assembly secured to the body, and an adjustable lower support assembly secured to the body for removably securing the first support standard with a first floor support sleeve. A second support standard includes a main body and an adjustable lower support assembly secured to the body for removably securing the second support standard with the second floor support sleeve. The system further includes a net support line removably attached to the tensioning assembly of the first support standard and to the second support standard. The adjustable lower support assembly includes a drive member for driving a slide member, a slide member housing, and at least one expansion member operatively connected to the slide member for engaging the corresponding floor support sleeve.

The exemplary embodiments of this disclosure are more particularly described below with reference to the drawings. Although specific terms are used in the following description for clarity, these terms are intended to refer only to the particular structure of the various embodiments selected for illustration in the drawings and not to define or limit the scope of the disclosure. The same reference numerals are used to identify the same structure in different Figures unless specified otherwise. The structures in the Figures are not drawn according to their relative proportions and the drawings should not be interpreted as limiting the disclosure in size or location.

With reference to FIG. 1, a first embodiment of a sports ball net support system 1 is shown. The net support system 1 generally includes, a primary support standard 10, a secondary support standard 12, an upper support line 14, and a lower support line 16. The primary and secondary standards 10, 12 are rigidly attached to a playing surface 18 through the use of an adjustable floor support assembly 20. The floor support assembly of each standard 10, 12 is received by a floor sleeve 22. Each floor sleeve 22 is securely fastened or embedded into a subsurface 24. Alternatively, an above-ground sleeve may also be used in place of the floor sleeve 22. In addition, the primary support standard 10 includes a net tensioning assembly 26 for generating tension along the upper support line 14 thereby tightening an associated sports ball net 28.

Figure 2A:
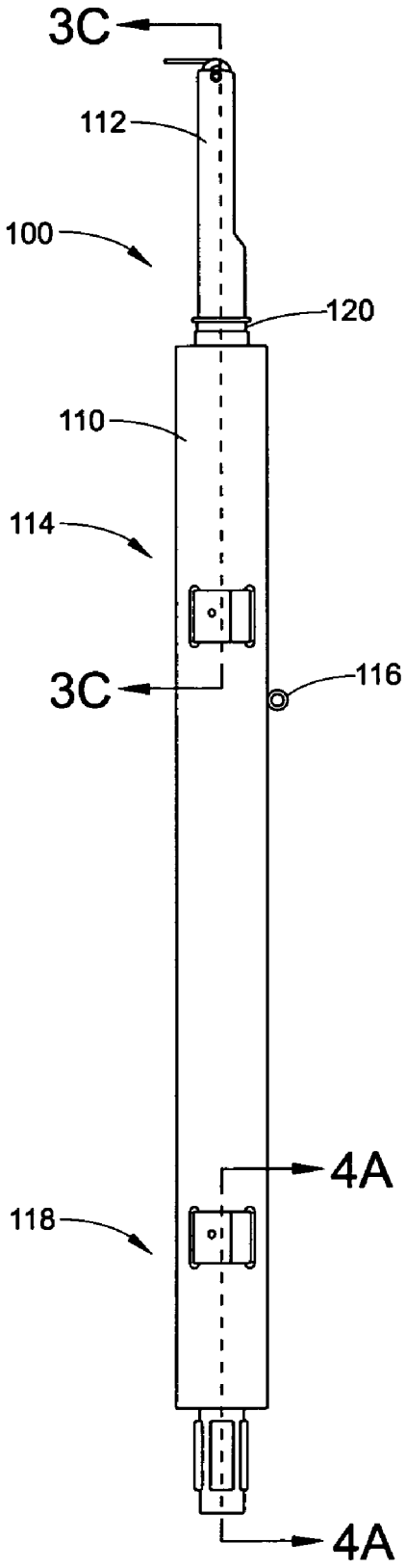
FIG. 2A is a front view of a first embodiment of a standard according to the present disclosure, illustrating an internal net tensioning assembly and an adjustable floor support assembly.
Figure 2B:
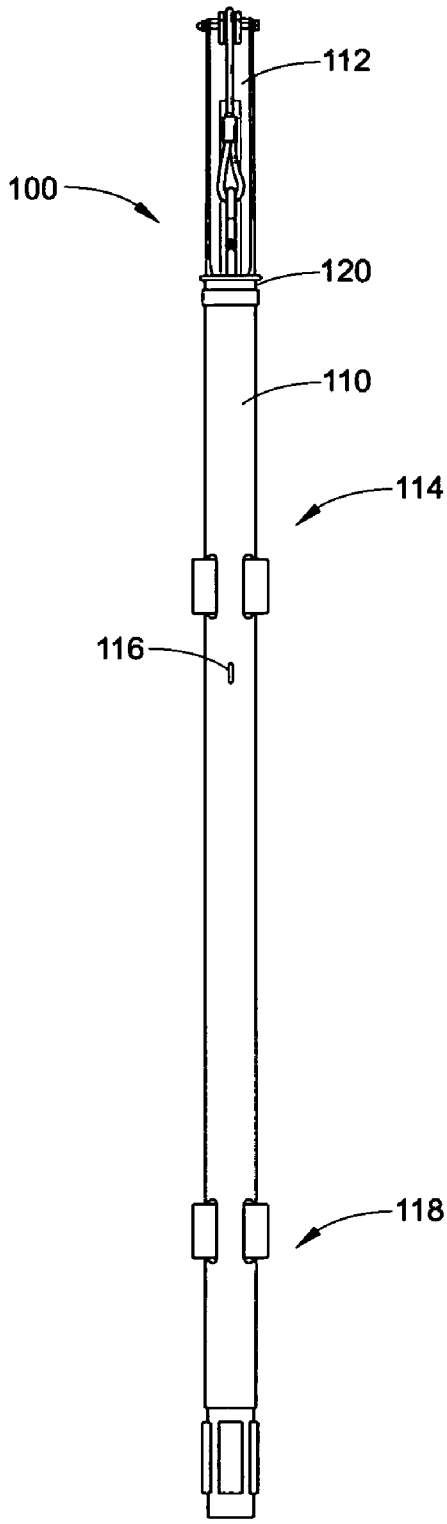
FIG. 2B is an edge or side view of the standard of FIG. 2A.

Now with reference to FIGS. 2A and 2B, a front and edge view of a first embodiment of the sports ball standard 100 is shown. The sports ball standard 100 generally includes a body or housing 110, an upper line adjustable support mast 112, a net tensioning assembly 114, a lower line support 116, and an adjustable floor support assembly 118. The support mast 112 is slideably engaged with the body 110 and may be locked into various height positions using a locking collar 120. In order to adequately support a sports ball net, two standards are generally required unless a stationary object (e.g. a wall or other rigid vertical surface) is used to fix one end of the net. In either case at least one standard must include a tensioning assembly for tightening the net. The standard which does not include a tensioning assembly will be referred to as a secondary standard whereas the standard including a tensioning assembly will be referred to as the primary standard. Other than FIG. 1, a primary type sports ball standard is depicted in the remainder of this specification.

Figure 3A:
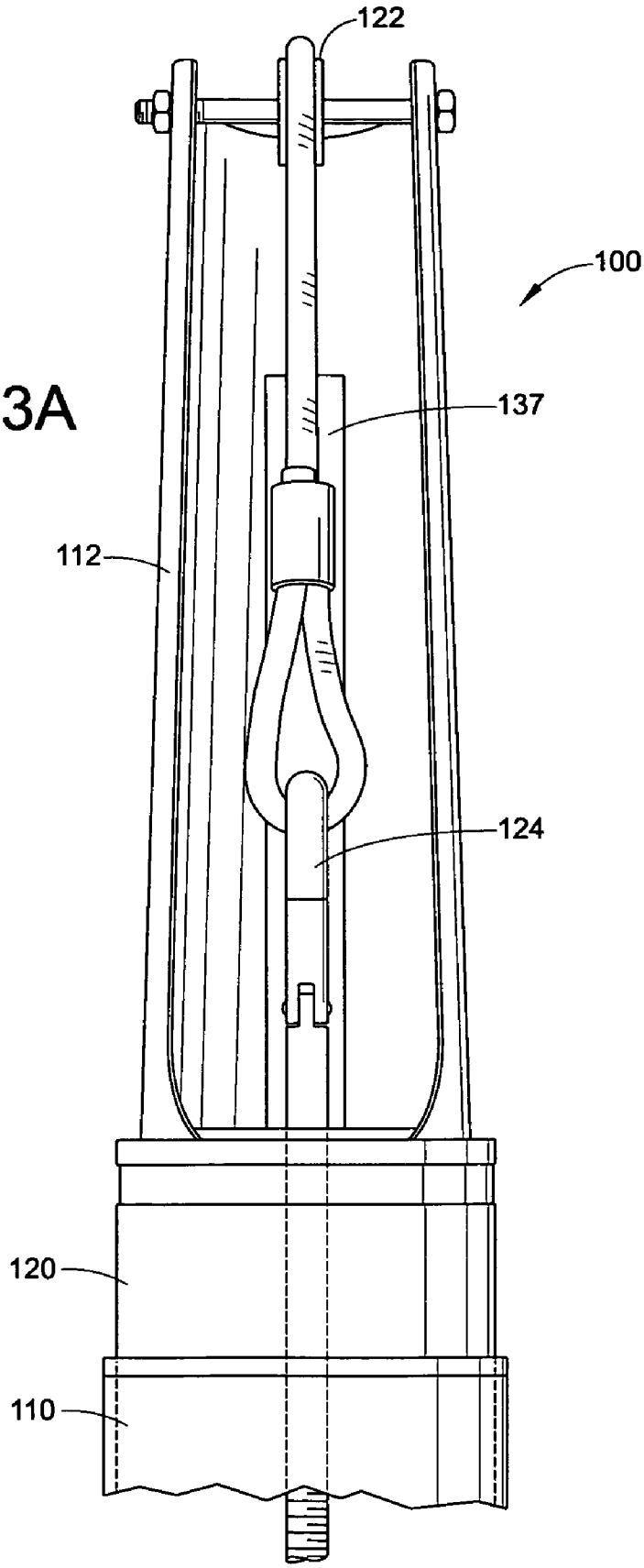
FIG. 3A is an enlarged front view of an upper portion of the standard of FIG. 2B.

With reference to FIG. 3A, an enlarged perspective view of an upper portion of the standard 100 is shown. Here, the support mast 112 and the locking collar 120 are clearly illustrated. As shown, an upper support line bends about a roller member 122 and is attached to a line clip 124 of the net tensioning assembly. Generally, when the net is tensioned using the net tensioning assembly, the line clip 124 is drawn in a downward direction and when the net is loosened the line clip 124 is urged in an upward direction to loosen the support line. As mentioned previously, the support mast 112 may be adjusted to the appropriate height by loosening the locking collar 120. The locking collar 120 is of a tapered ball design. When an inner portion of the collar is translated upward, a plurality of partially exposed balls retracts allowing the support mast 112 to slide freely. However, when the inner portion of the collar is urged downward, the plurality of balls ride along a tapered surface of the locking collar causing the plurality of balls to exert a binding force against the support mast 112 thus locking the support mast 112 in place. A locking collar having an elliptical design may also be used. The elliptical design locking collar would permit an outer elliptical portion of the collar to rotate relative to an inner elliptical portion of the collar. The inner elliptical portion would be rigidly secured to the body 110. As the outer elliptical portion would be rotated, it would bind or frictionally engage an outer wall of the support mast 112.

Figure 3B:
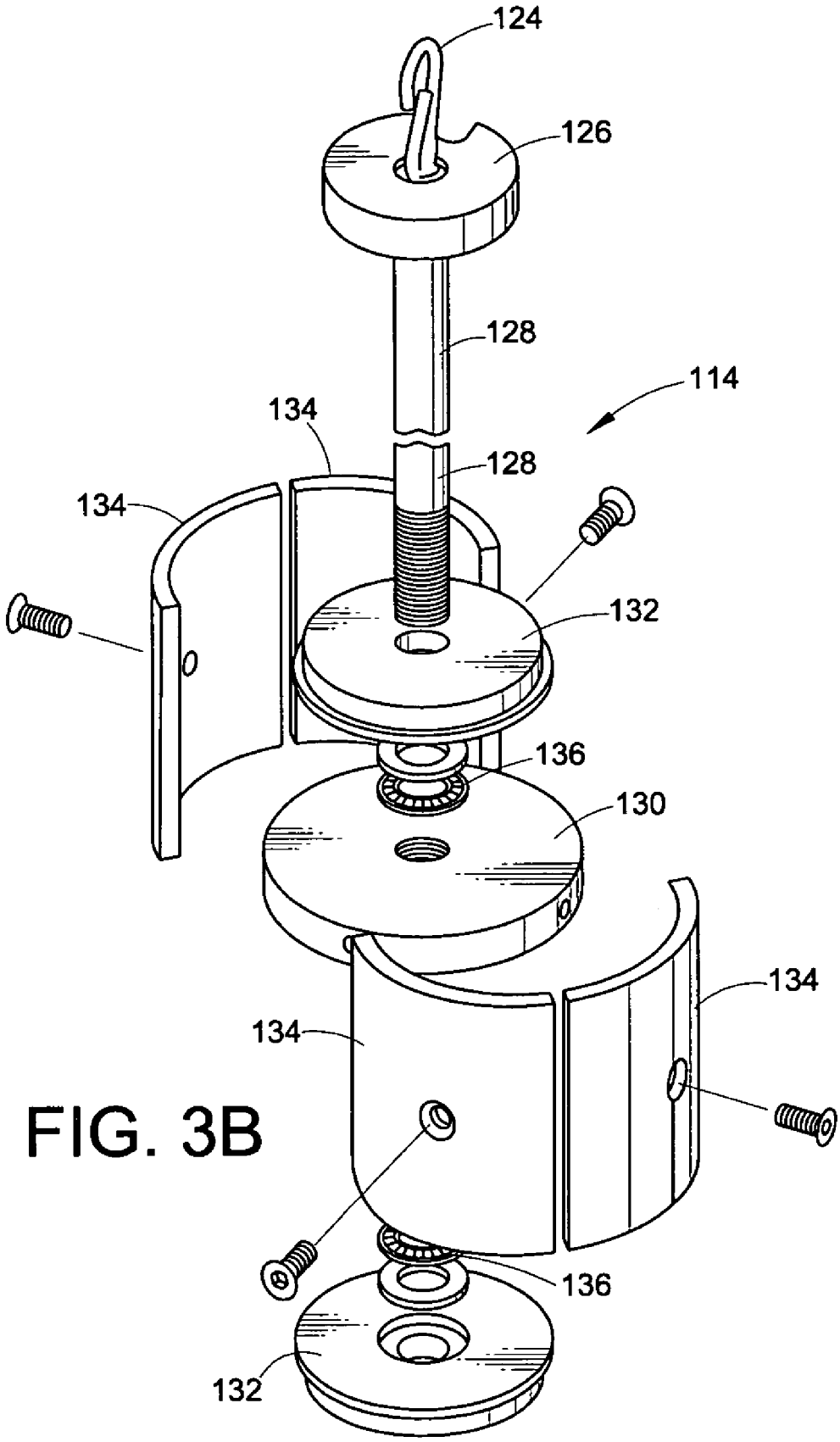
FIG. 3B is an exploded view of the internal tensioning assembly of the standard of FIG. 2A.
Figure 3C:
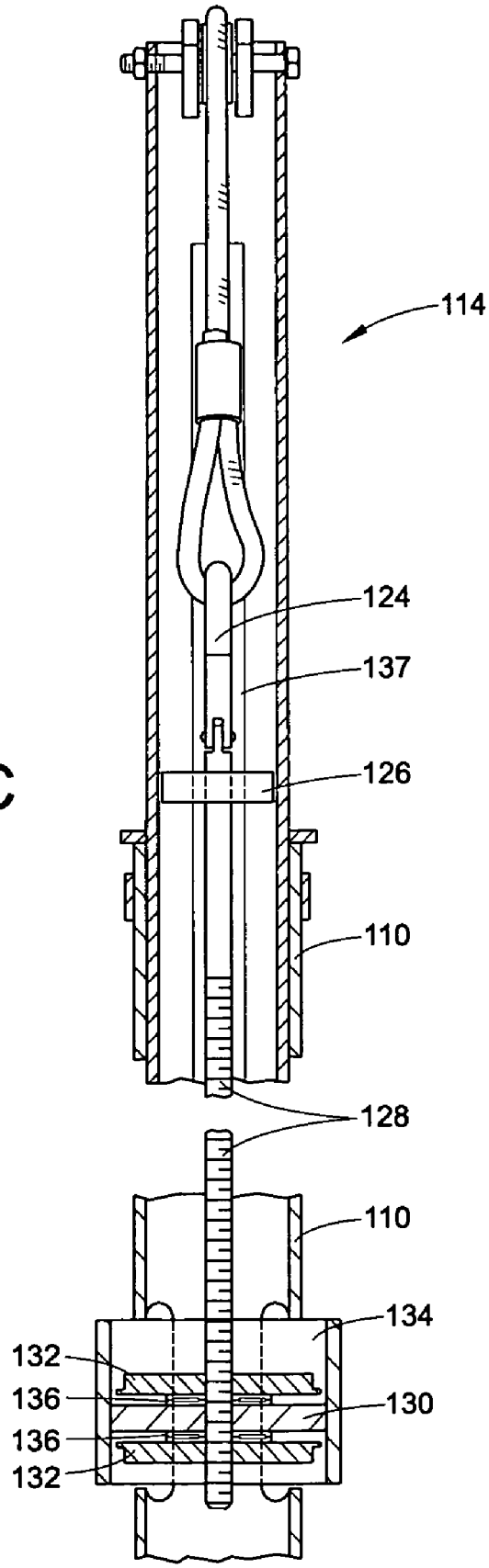
FIG. 3C is a cross sectional view of the internal tensioning assembly of the standard of FIG. 2A along a section 3C-3C.

With reference to FIGS. 3B and 3C, an exploded view and cross sectional view of the net tensioning assembly 114 are shown. Generally, the tensioning assembly 114 includes, the line clip 124, an anti-rotation member 126, a threaded drive rod 128, and a threaded drive member 130. The drive member 130 is confined between two mounting plates 132. As the drive member 130 is rotated, the drive rod 128 is either urged in an outward or inward direction with respect to the body 110. To increase the amount of leverage and grip when rotating the drive member 130, a large knurled drum-type handle 134 may be attached to the drive member 130. The thread pitch of the threaded drive rod and the threaded drive member can be standard ACME /1;2-13. As such, for every thirteen turns of the handle the threaded drive rod will translate one inch. Of course, various standard or metric thread pitches may be used. The thread pitch that is selected ultimately depends on the maximum tension and self-locking characteristics that are desired of the net tensioning assembly.

As shown in FIGS. 3B and 3C, the handle 134 may be made in multiple pieces to facilitate manufacturing and to reduce the amount of material removed from a region on the body 110 (FIG. 3C) proximal to the handle 134. Furthermore, each mounting plate 132 may include an embedded thrust bearing 136 for reducing rotation drag between the drive member 130 and each mounting plate 132. The anti-rotation member 126 prevents the rod 128 and line clip 124 from rotating when the user rotates the threaded drive member 130. Specifically, the anti-rotation member includes a notch which engages a key 137 (FIGS. 3A and 3C). The key 137 is rigidly attached along an inner surface of the support mast 112 along a longitudinal axis of the support mast 112. As shown in FIGS. 3A and 3C, the key 137 is of a square geometry.

Figure 4A:
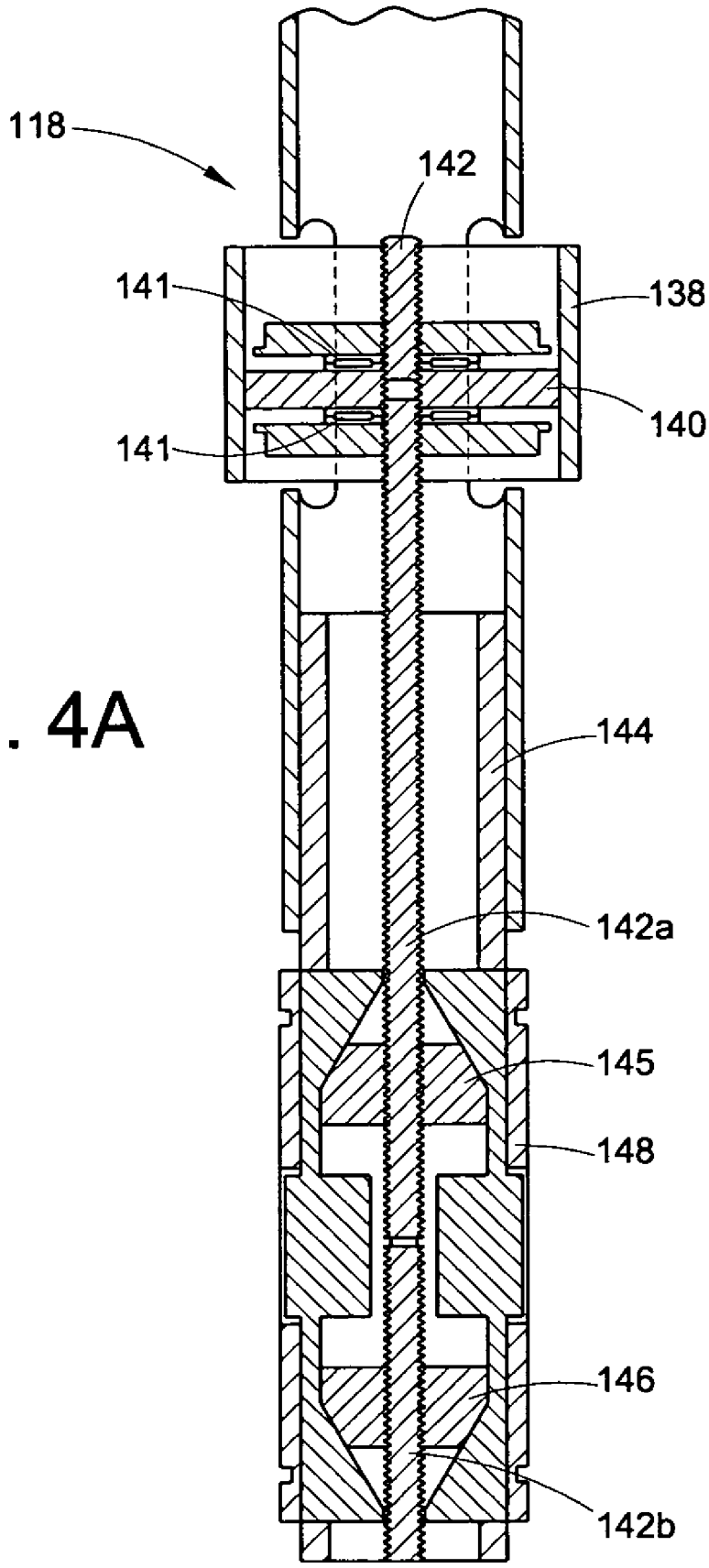
FIG. 4A is a cross sectional view of the adjustable floor support assembly of the standard of FIG. 2A along a section 4A-4A.
Figure 4B:
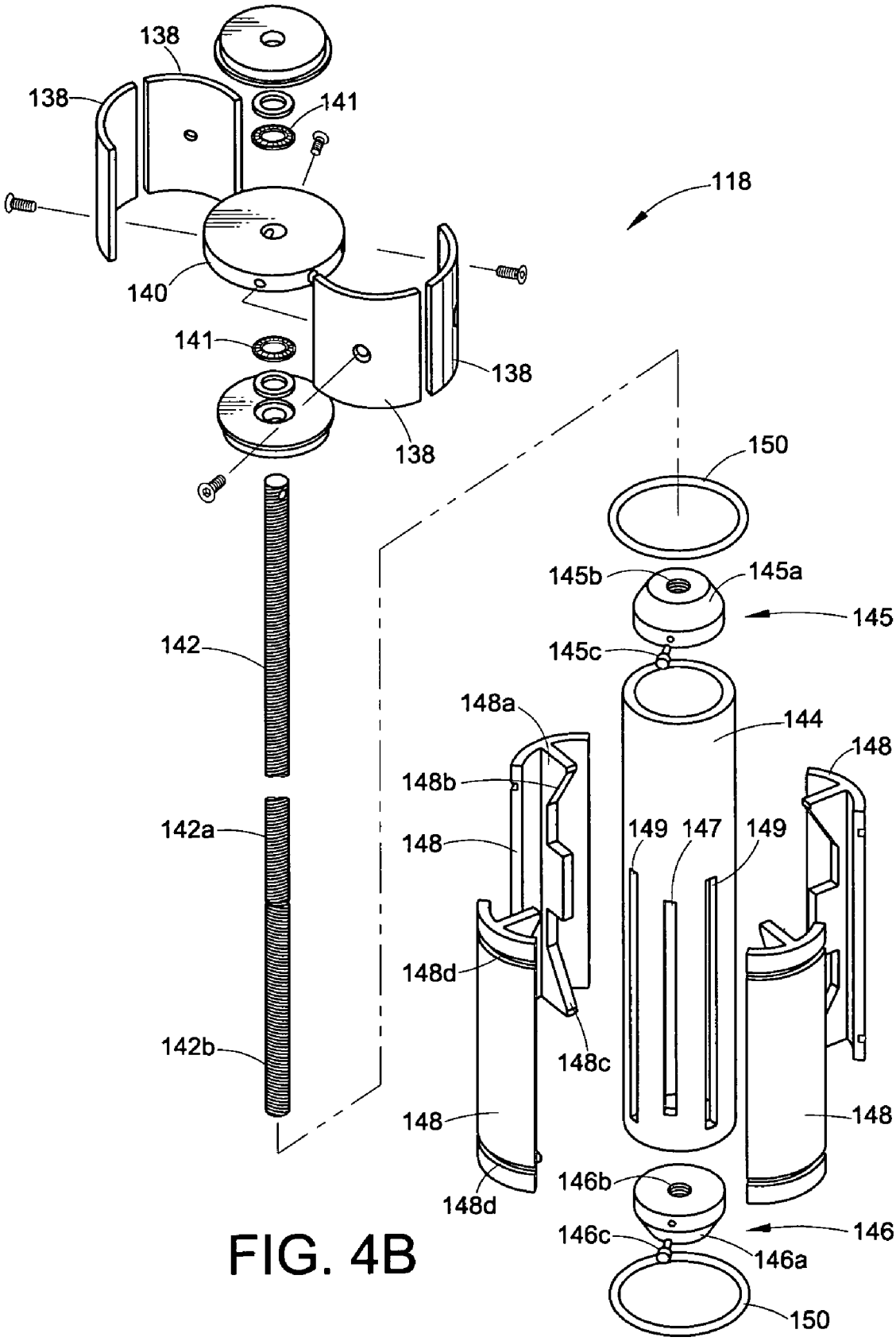
FIG. 4B is an exploded view of the adjustable floor support assembly of the standard of FIG. 2A.
Figure 5A:
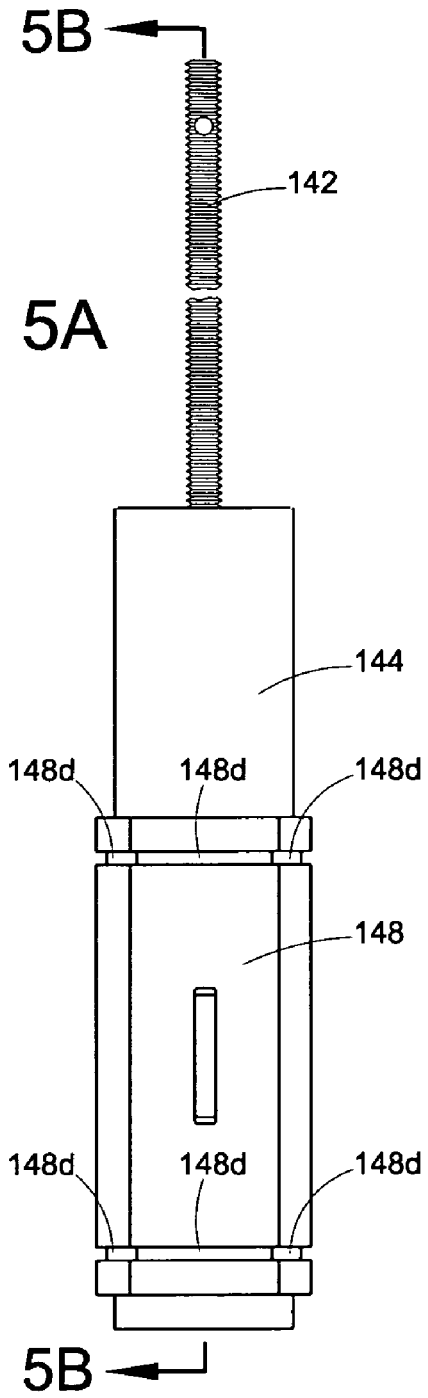
FIG. 5A is a side view of a lower portion of the adjustable floor support assembly of the standard of FIG. 2A, illustrating a slide member housing, a slide member, and a plurality of expansion members.
Figure 5B:
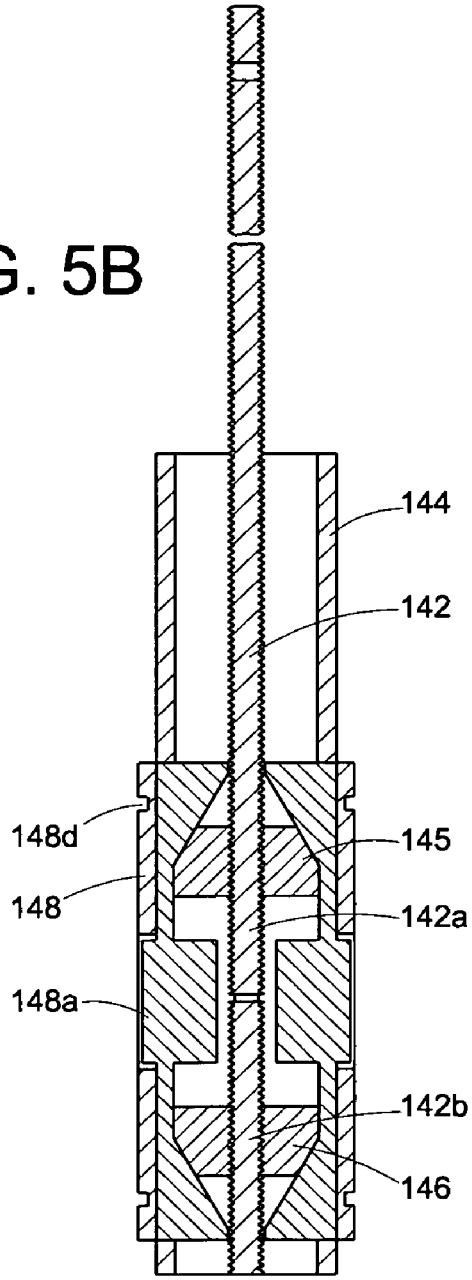
FIG. 5B is a cross sectional view of the lower portion of the adjustable floor support assembly of FIG. 5A along a section 5B-5B.
Figure 5C:
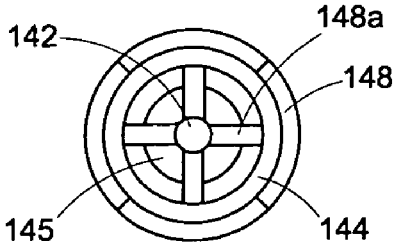
FIG. 5C is a bottom view of the lower portion of the adjustable floor support assembly of FIG. 5A.

Now with reference to FIGS. 4A and 4B, a cross-sectional view and an exploded view, respectively, of the adjustable floor support assembly 118 is shown. The upper portion or structure of the adjustable floor support assembly 118 is similar to the lower portion of the net tensioning assembly. In particular, the adjustable floor support assembly 118 uses a drum-like handle 138 attached to a drive disc 140. As before, the disc 140 is captured between a pair of thrust bearings 141 to help reduce friction. However, the adjustable floor support assembly 118 differs in that the drive rod 142 includes a standard right hand threaded portion 142*a* and a reverse or left hand threaded portion 142*b*. In addition, the drive rod 142 rotates in place and does not itself move in an axial or longitudinal direction. The drive rod 142 extends into a tubular slide member housing 144 eventually engaging an upper slide member 145 and a lower slide member 146. The upper slide member 145 engages the right hand threaded portion 142*a* while the lower slide member 146 engages the left hand threaded portion 142*b* of the drive rod 142. As such, when the drive rod 142 is rotated the slide members 145,146 will move simultaneously in opposite directions. As understood to one skilled in the art, the standard and reverse threaded portions could be switched. Switching these portions would only affect the direction of rotation required to tighten or loosen the adjustable floor support assembly 118.

With reference to FIGS. 4A-5C, the slide members 145, 146 are permitted to travel in a linear direction within the slide member housing 144. The slide members 145, 146 are generally cylindrical and include a tapered thrust surface 145*a*, 146*a*. Also, the slide members include a threaded bore 145*b*, 146*b*. The slide members include at least one anti-rotation guide pin. As shown in FIG. 4B, the upper slide member 145 includes an anti-rotation guide pin 145*c* and the lower slide member 146 also includes an anti-rotation guide pin 146*c*. When fully assembled, the guide pins 145*c*, 146*c* are received into a guide slot 147. The threaded portions 142*a*, 142*b* are received by the threaded bores 145*b*, 146*b* in the slide members 145, 146. As the drum or handle 138 is rotated, the drive rod 142 rotates and the slide members 145, 146 begin to slide in opposite directions.

With continued reference to FIGS. 4A-5C, the slide members 145, 146 are received into the slide member housing 144 and engage a plurality of expansion members 148. The expansion members include a rearward projecting portion 148*a*, an upper reaction surface 148*b*, a lower reaction surface 148*c*, and a pair of retaining grooves 148*d*. The expansion members are received into the slide member housing 144 through a plurality of vertically oriented slots 149 disposed about the circumference of the slide member housing 144. A close yet non-binding fit is created between the expansion member 148 and the slot 149. This close fit provides additional lateral stability for the one or more expansion members. As shown in FIG. 4B, the reaction surfaces 148*b*,148*c* are cut along a bevel matching the taper of the slide members 145, 146. Due to the angular or bevel cut of the reaction surfaces 148*b*,148*c* the expansion members 148 will traverse radially outward as the slide members 145, 146 travel linearly along the slide member housing 144. For example, as the upper slide member 145 moves upward, the slide member 145 moves relative to the upper reaction surface 148*b* generating an outward force on the expansion pads 148 causing the expansion members 148 to move outward. Similarly, when the lower slide member 146 moves downward (due to the reverse pitch of the threaded portion 142*b*), the expansion members 148 are also urged outward due to the force exerted on the lower reaction surface 148*c* of the expansion pad 148. Because two reaction surfaces are used that are at equidistant opposite ends of the expansion member, the forces generated remain balanced. This balancing prevents the expansion members from "locking" or jamming within the slot 149 and provides further stability for the standard within the floor sleeve. The retaining groove 148*d* is intended to receive an elastic or flexible biasing member 150. By way of example, the biasing member may be an 'O' ring or a snap ring. The biasing member 150 produces and maintains a continuous inwardly radial force that prevents the expansion members from becoming disengaged from the slide members 145, 146.

As shown in FIGS. 4B-5C, the expansion members 148 of the first embodiment are separated at 90° from one another. This provides for an overall balanced frictional lock between the floor support assembly and the floor support sleeve. It should be noted that any number of expansion members could be used depending on the given application. In fact, to reduce manufacturing and product costs, the adjustable foot assembly could be manufactured to include just one fixed member and one moveable expansion member. In other words, it is possible to secure the standard by having one fixed pad or member and one moveable pad or member oriented 180 degrees from the other.

Figure 6A:
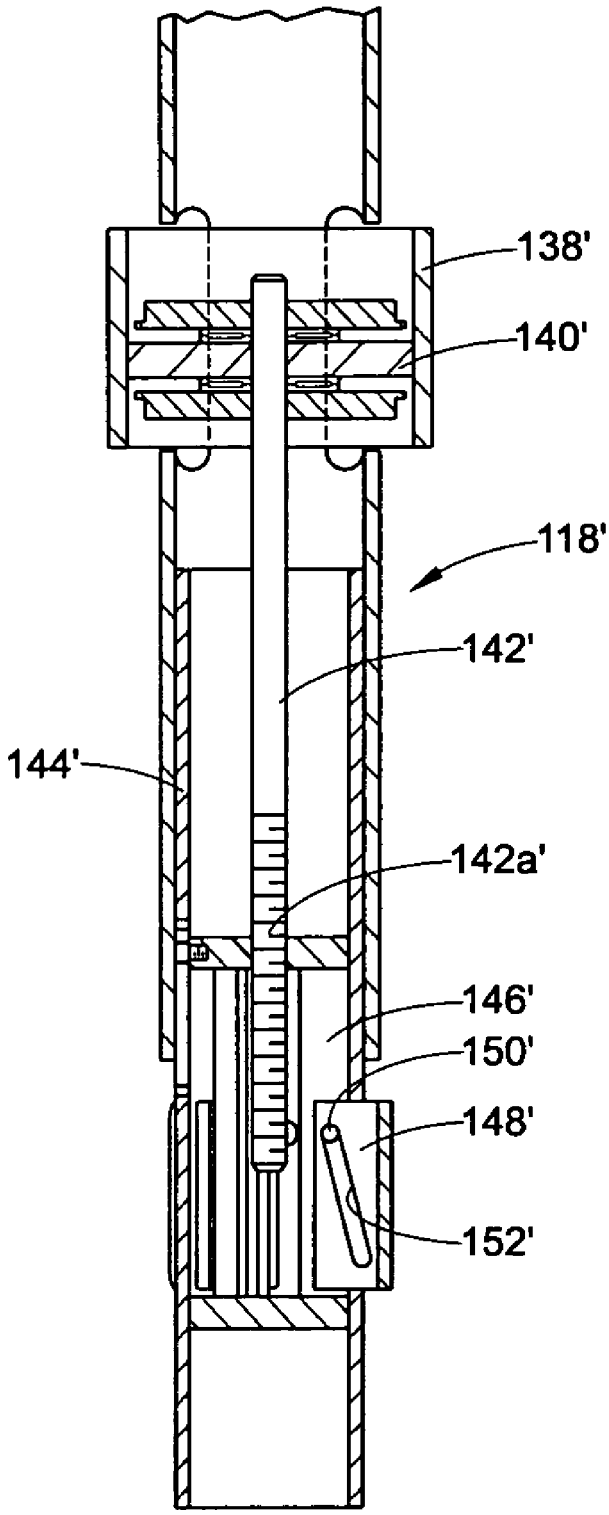
FIG. 6A is a cross sectional view of an alternate embodiment of an adjustable floor support assembly.
Figure 6B:
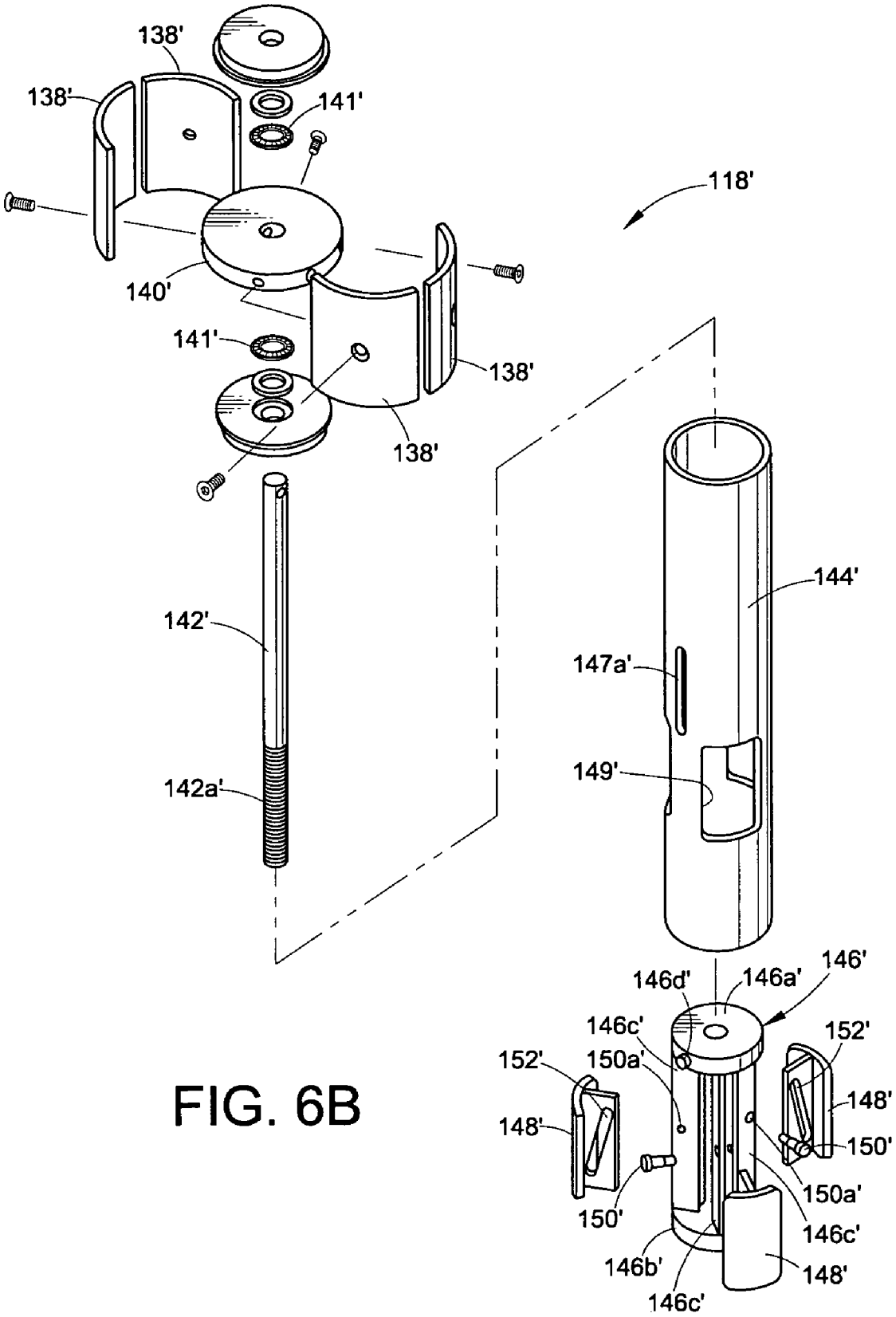
FIG. 6B is an exploded view of the adjustable floor support assembly of FIG. 6A.
Figure 7C:
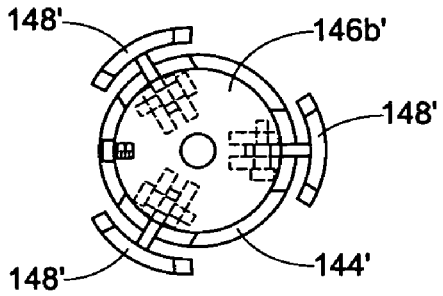
FIG. 7C is a cross sectional view of the lower portion of the adjustable floor support assembly of FIG. 7B along a section 7C-7C.
Figure 7B:
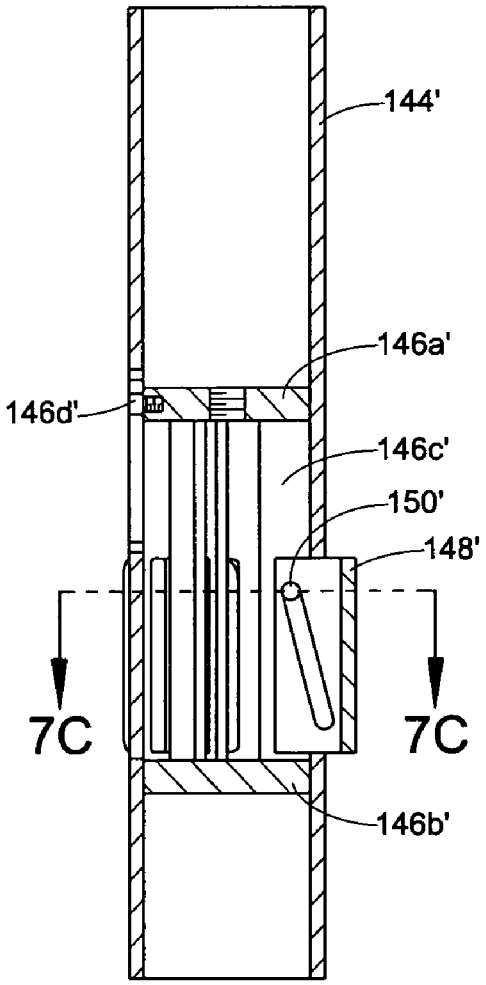
FIG. 7B is a cross sectional view of the lower portion of the adjustable floor support assembly of FIG. 7A along a section 7B-7B.
Figure 7A:
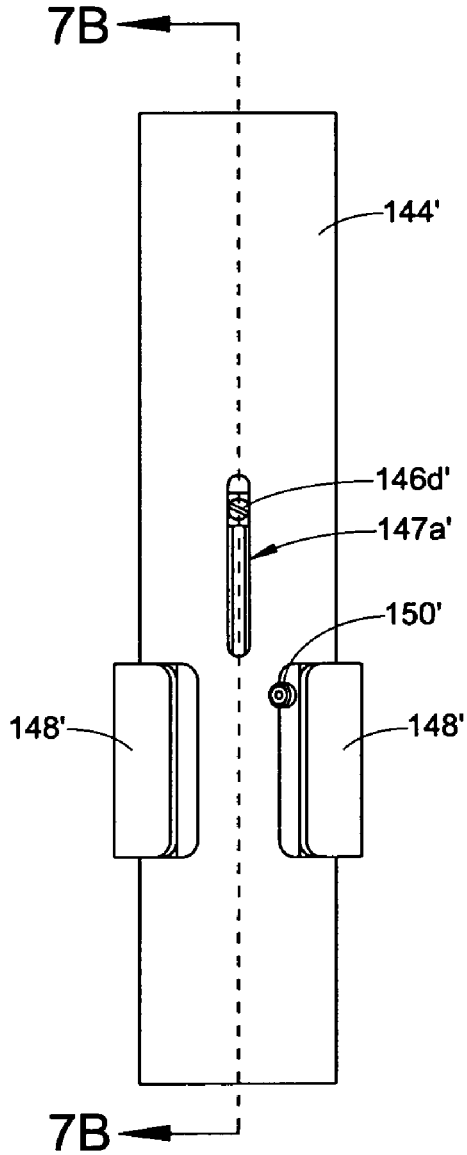
FIG. 7A is a side view of a lower portion of the adjustable floor support assembly of FIG. 6A, illustrating a slide member housing, a slide member, and a plurality of expansion members.

Now with reference to FIGS. 6A and 6B a cross-sectional view and an exploded view of an alternate embodiment of an adjustable floor support assembly 118' is shown. The upper portion or structure of the adjustable floor support assembly 118' is similar to the lower portion of the net tensioning assembly. In particular, the adjustable floor support assembly 118' uses a drum-like handle 138' attached to a drive disc 140'. As before, the disc 140' is captured between a pair of thrust bearings 141' to help reduce friction. However, the adjustable foot assembly 118' differs in that the drive disc 140' is rigidly attached to a drive rod 142' having a threaded end portion 142*a*'. Here, the drive rod rotates and does not move in an axial or longitudinal direction. The threaded end portion 142*a*' extends into a tubular slide member housing 144' eventually engaging a slide member 146'. Naturally, the orientation of the threaded end portion 142*a*' and of the drive rod 142' could be reversed such that the threaded end portion would engage the drive disc rather than the slide member. As such, the drive rod would be fixed to the slide member and would not rotate. In this manner, the overall operation of the adjustable floor support assembly would be even more similar to that of the net tensioning assembly.

With reference to FIGS. 6A-7C, the slide member 146' is permitted to travel in a linear direction within the slide member housing 146'. The slide member 146' is generally cylindrical and includes an upper bushing 146*a*', a lower bushing 146*b*', and a plurality of connecting plates 146*c*' disposed between the upper and lower bushings 146*a*', 146*b*'. In addition, the slide member may include one or more anti-rotation guide pins. As shown in FIG. 6B, the upper bushing 146*a*' includes an anti-rotation guide pin 146*d*'. When fully assembled, the guide pin 146*d*' is received into a guide slot 147*a*'. An additional guide pin could be added to the lower bushing 146*b*' and be received by a corresponding guide slot on the slide member housing 144' to further stabilize the slide member 146'. The threaded end portion 142*a*' is received by a threaded aperture in the upper slide member bushing 146*a*'. As the drum or handle 138' is rotated, the drive rod 142' rotates and the slide member begins to slide in an upward or downward direction (depending on the direction the handle 138' is rotated).

With continued reference to FIGS. 6A-7C, during assembly, the slide member 146' is received into the slide member housing 144'. Then, at least one expansion member 148' is operatively attached to the connecting plates 146*c*' of the slide member 146'. In order to do so, the connecting plates 146*c*' are aligned with at least one expansion member aperture 149'. The aperture 149' can be geometrically similar to the outer shape of the expansion member 148' such that when expansion member is inserted into the aperture 149' it creates a close yet non-binding fit. Next, a slide pin 150' is inserted through a corresponding slide pin aperture 150*a*' in the connecting plate 146*c*', through an expansion slot 152' in the expansion member, and pressed or fastened securely in place. Although the slide pin 150' is securely held in place by one or more connecting plates 146*c*', a shoulder of the slide pin 150' is slightly smaller in diameter than the width of the expansion slot 152', thus permitting the slide pin to move along the expansion slot 152'. As shown in FIG. 6B, the expansion slot 152' is cut along a diagonal, starting at an upper and rearward position and ending at a lower and forward position. Due to the angular or diagonal cut of the expansion slot 152', the expansion member 148' will traverse radially outward as the slide pin 150' and slide member 146' travel upward and vice versa. Specifically, as the slide member 146' and slide pins 150' move upward, the slide pins 150' move relative to the expansion slots 152' generating a force against the slots 152'. The force that is exerted causes the expansion members 148' to move outward. Similarly, when the slide member 146' moves downward, the expansion members 148' are retracted into the tubular slide member housing 144'. The linear slot 147*a*' cut into the slide member housing 144' cooperates with the guide pin 146*d*'. The guide pin 146*d*' not only prevents the slide member 146' from rotating within the slide member housing 144' but may also limit the upward and downward travel of the slide member 146'.

Figure 8:
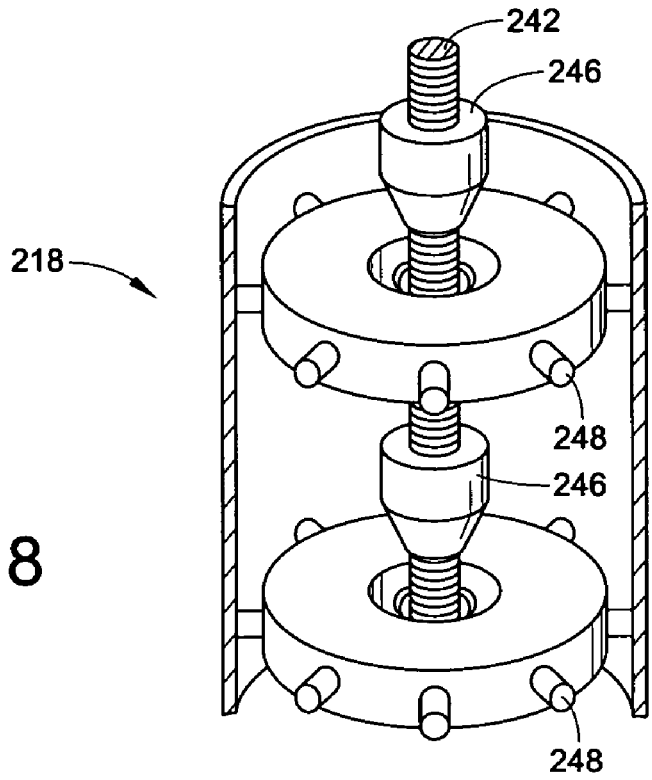
FIG. 8 is a perspective front view of a second embodiment of an adjustable floor support assembly for a standard according to the present disclosure.
Figure 9:
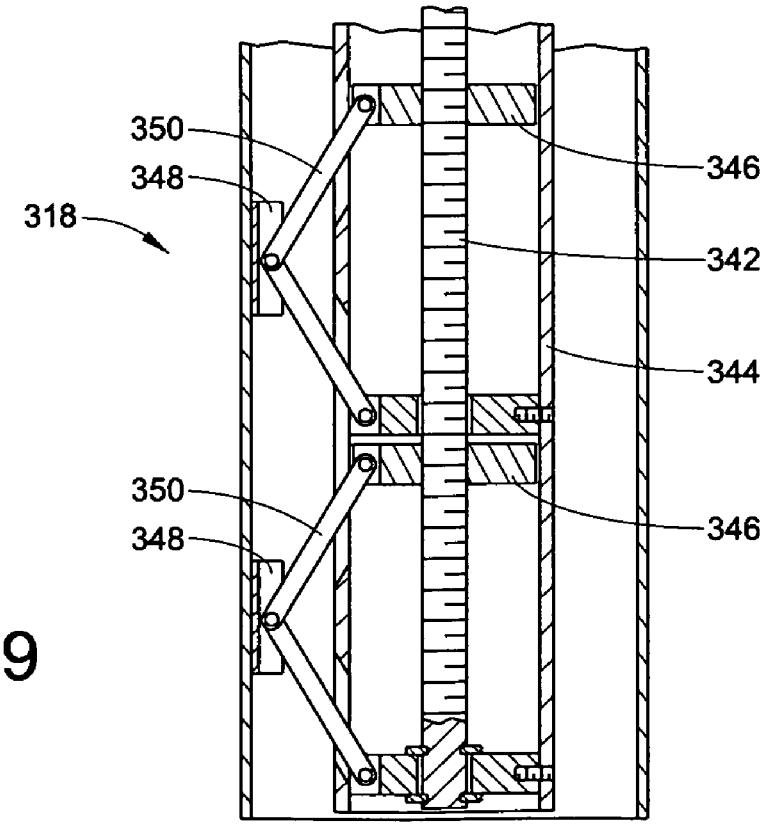
FIG. 9 is a cross sectional view of a third embodiment of an adjustable floor support assembly for a standard according to the present disclosure.

With reference to FIGS. 8 and 9, two alternate embodiment designs are shown for a floor support assembly. FIG. 8 illustrates a floor support assembly 218 using two conical slide members 246 which exert a force on a plurality of radially located expansion pins 248. As in the first embodiment, a handle may be used to drive a threaded drive rod 242 to drive the conical slide members 246 downward or to retract the slide members upward. In this embodiment, both conical slide members 246 move in the same direction simultaneously rather than in opposite directions. Furthermore, the pins 248 may also include a biasing element to cause the pins to retract once the conical slide members have traversed far enough upward.

FIG. 9 illustrates yet another embodiment of an adjustable floor support assembly 318. Here, a threaded drive rod 342 engages a pair of threaded slide members 346. A pair of expansion members 348 is operatively connected to a linkage 350. An upper bar of the linkage is connected to the threaded slide member 346 while a lower bar of the linkage 350 is fixed to the slide member housing 344. As the drive rod 342 rotates the expansion member are driven either outward or inward. One possible benefit of this embodiment is the great deal of mechanical advantage and force that can be generated using a three bar sliding linkage of this type. It should be noted that it is possible to incorporate a three, four, five or more linkage design to increase the pressure generated between the expansion member and the floor sleeve.

Figure 10A:
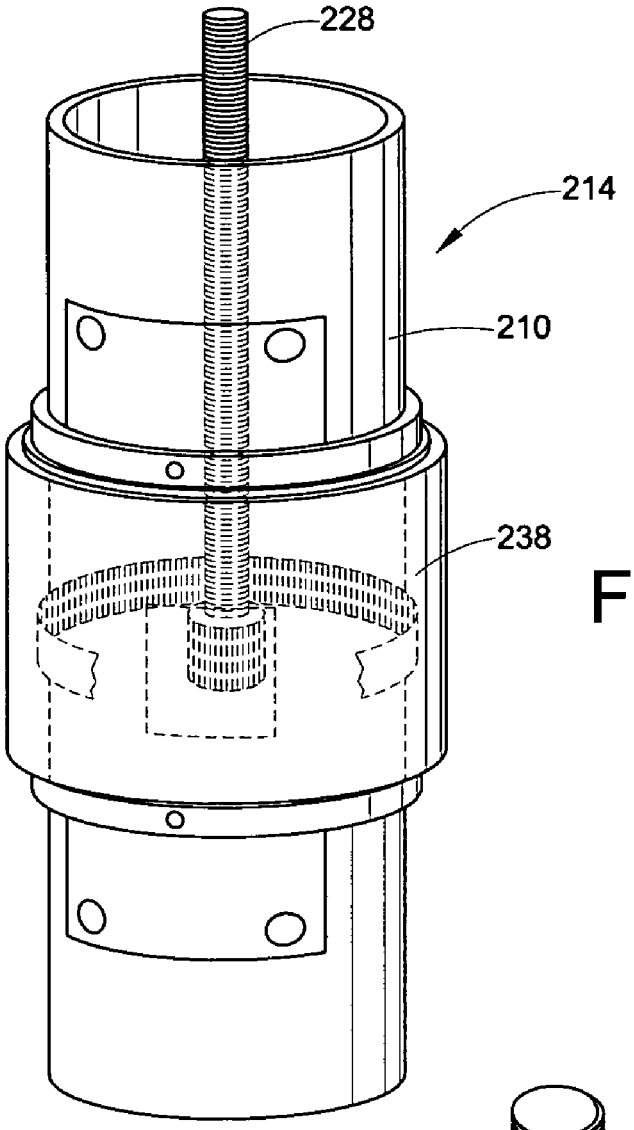
FIG. 10A is a perspective view of a second embodiment of a net tensioning assembly for a standard according to the present disclosure, illustrating an internal gear driven tensioning assembly.
Figure 10B:
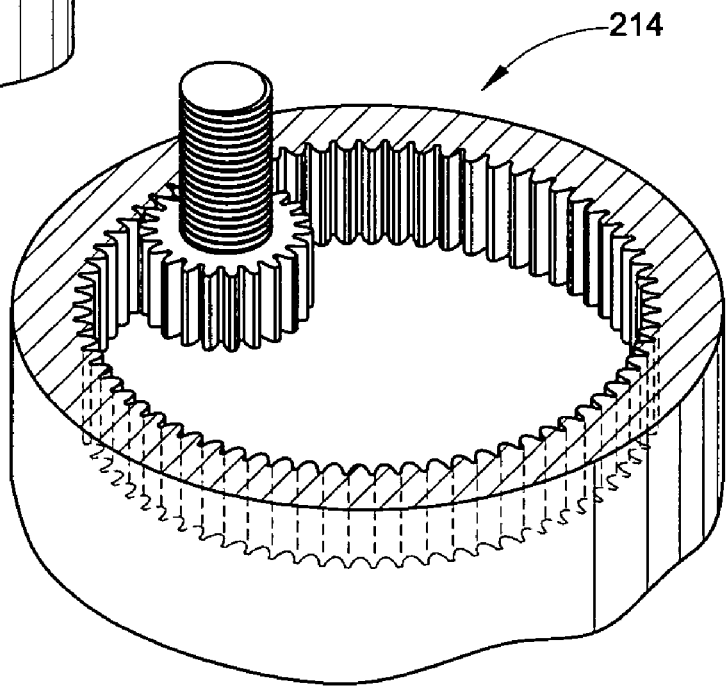
FIG. 10B is an enlarged perspective view of a gear assembly of the net tensioning assembly of FIG. 10A.
Figure 11A:
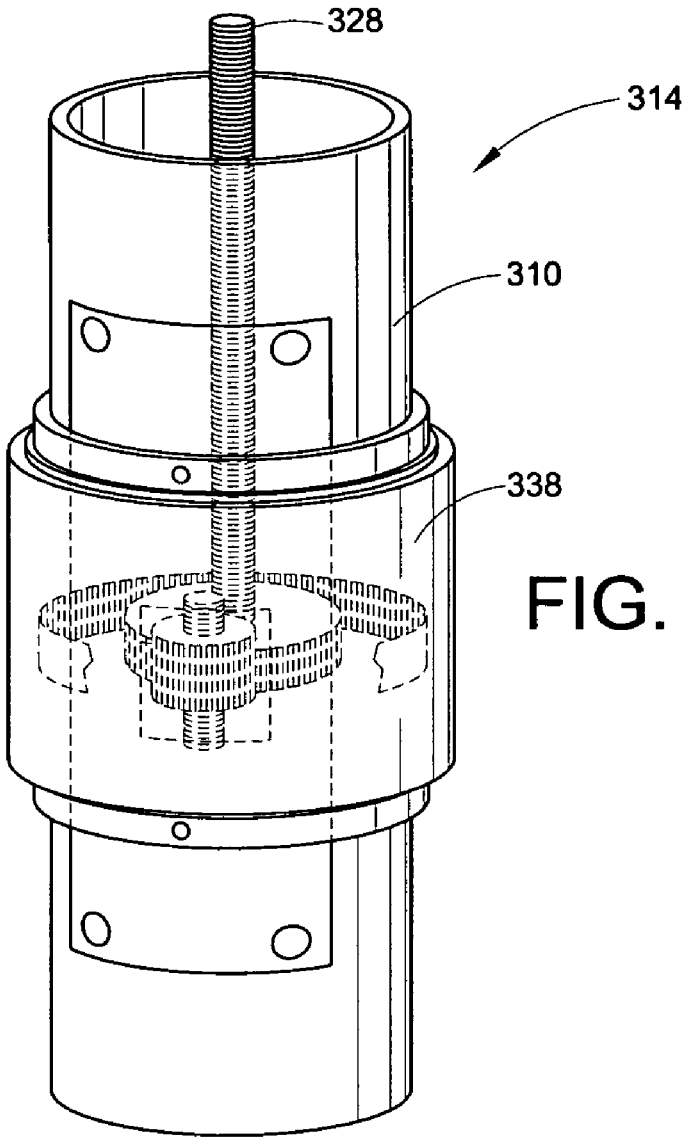
FIG. 11A is a perspective view of a third embodiment of a net tensioning assembly according to the present disclosure, illustrating a centrally oriented drive rod with greater gear reduction.
Figure 11B:
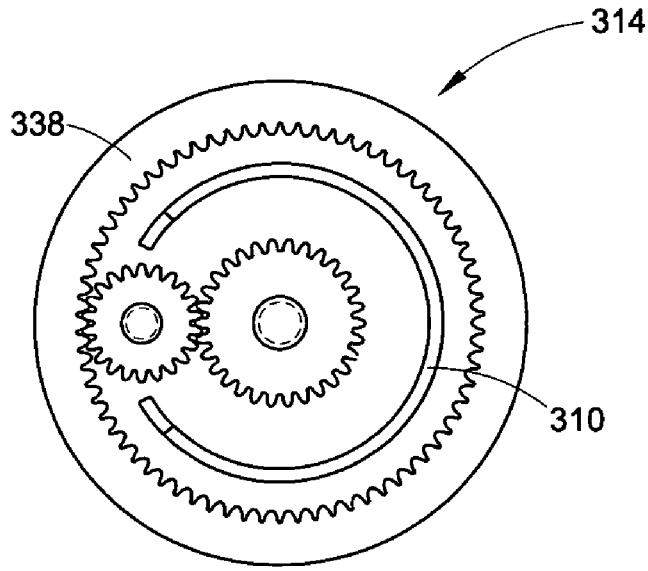
FIG. 11B is a cross sectional view of the net tensioning assembly of FIG. 11A.

Now with reference to FIGS. 10A-10B, a second embodiment for a net tensioning assembly 214 is shown. A handle 238 having internal gear teeth is shown. The handle operatively rides on an outer circumference of a body 210 of a standard. A mounting plate having an aperture permits the internal gear teeth of the handle to contact a pinion gear disposed on the end of a threaded drive rod 228. This embodiment clearly shows that a compact and low profile net tensioning assembly may be embedded in a tubular body 210 while retaining the aesthetic, cost, and functional appeal of an outer rotating drum-like handle. This provides for yet another substantially enclosed or internal winch type tensioning assembly that can be fitted over a round or tubular central portion. FIGS. 11A and 11B illustrate a third embodiment of a net tensioning assembly 314. The third embodiment of the net tensioning assembly 314 is similar to the second embodiment of the net tensioning assembly 214 and differs only in that a threaded drive rod 328 is now centered in a body 310 and includes an intermediate gear. The intermediate gear engages a set of internal gear teeth along an inner surface of a handle 338 as well as a pinion gear at the end of the drive rod 328. The third embodiment 314 has the benefit of producing more mechanical advantage than the second embodiment 214 due to the additional gearing.

Figure 12:
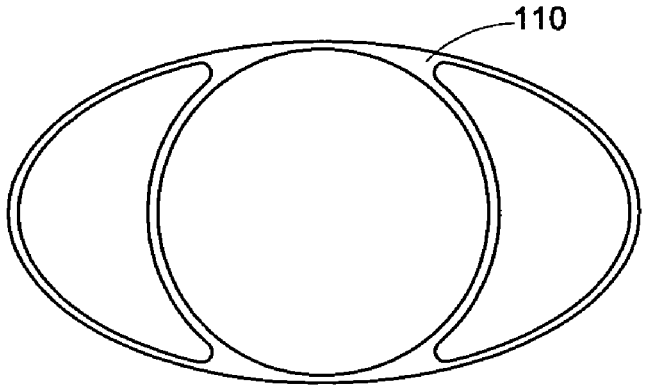
FIG. 12 is a cross sectional view of a body portion of the standard of FIG. 2A
Figure 13:
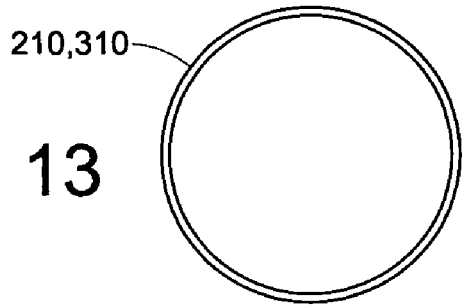
FIG. 13 is a cross sectional view of the body portions of the standards of FIGS. 10A and 11A.

Lastly, with reference to FIGS. 12-16, various body cross-sections are shown. Specifically, FIG. 12 illustrates the cross section of the body 110 of the first embodiment of the sports ball standard described previously. The first embodiment of the sports ball standard 100 utilizes an oval geometry to provide an adequate surface for the user to grip the drum like handles of the net tensioning and adjustable floor support assemblies while not sacrificing load carrying capability in the direction of the sports ball net. As shown previously, the second and third embodiments may use a circular type body 210, 310 as shown in FIG. 13. Although, the use of a circular cross section may be preferred from a manufacturing and cost perspective it is slightly more difficult to incorporate the internal net tensioning assemblies 214,314 as shown in FIGS. 10A-11B.

Figure 14:
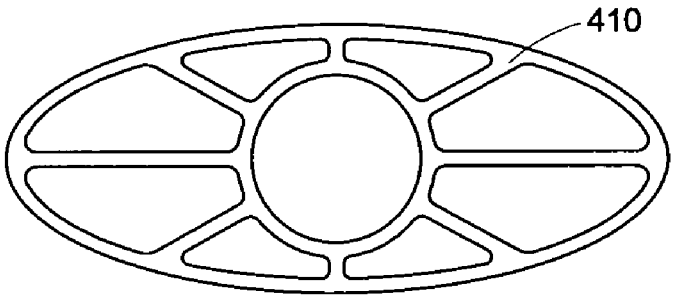
FIG. 14 is a cross sectional view of a body portion of a fourth embodiment of a standard according to the present disclosure, illustrating an elongated oval cross section with multiple reinforcing ribs.

With reference to FIG. 14, a fourth embodiment of a standard body 410 is shown. The cross section of the fourth embodiment is similar to that of the body 110 of the first embodiment. However, the general oval or elliptical shape of the body 410 is further pronounced and includes several reinforcing ribs or spars.

Figure 15:
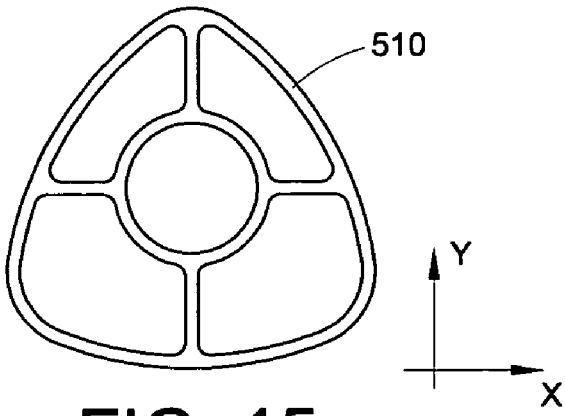
FIG. 15 is a cross sectional view of a body portion of a fifth embodiment of a standard according to the present disclosure, illustrating a tri-lobe cross section.

With reference to FIG. 15, a fifth embodiment of a body 510 is shown. The fifth embodiment illustrates the body 510 with a tri-lobed cross section. This cross section design also permits the use of the net tensioning assembly and adjustable floor support of the first standard embodiment. This is so because a drum like handle can still be accessed by the user even if embedded along a central longitudinal axis of the standard (as is the case with the first embodiment of the standard 100). One added benefit of the fifth embodiment is that it is more compact than the first or fourth embodiments and has an equivalent amount of rigidity in the both the X and Y directions.

Figure 16:
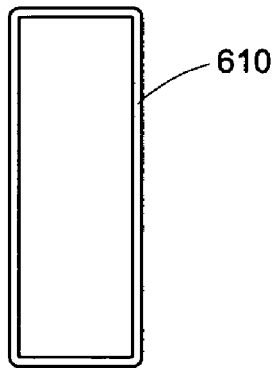
FIG. 16 is a cross sectional view of a body portion of a sixth embodiment of a standard according to the present disclosure, illustrating a rectangular cross section.

With reference to FIG. 16, a sixth embodiment of a body 610 is shown. The sixth embodiment illustrates the body 610 having a rectangular cross section. As with the previous embodiments, the rectangular cross section of the body 610 allows for a handle of a net tensioning assembly or an adjustable floor support to be embedded into the rectangular cross section. Of course, other standard or upright body housings may be made from various geometric shapes. Because each geometric configuration or cross section provides a different area moment of inertia, the resulting stiffness characteristics for a given standard will vary dramatically. Therefore, depending on the application, one cross sectional geometry may be preferred over another.

Further still, the various embodiments of support standards discussed above may further include at least one transport handle or shoulder strap for allowing an individual to conveniently carry the standard. The at least one handle or strap may be detachable and can be located anywhere along the body of the standard. Preferably, the at least one handle or strap is located about the center of gravity of the standard such that only one handle or strap is required.

Finally, it should be noted that the embodiments of the present disclosure could be easily adapted for most any sport that involves the use of suspended net. Such examples of sports where the present embodiments could be employed include, but are not limited to, tennis, badminton, and pickle ball.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A system for supporting a sports ball net, the system adapted to be mounted to a first floor support sleeve and a second floor support sleeve, the system comprising:

a first support standard having a main body, a net tensioning assembly secured to the body, and an adjustable lower support assembly secured to the body for removably securing the first support standard with the first floor support sleeve;

a second support standard having a main body and an adjustable lower support assembly secured to the body for removably securing the second support standard with the second floor support sleeve;

a support line having a proximal end and a distal end, the proximal end being removably attached to the tensioning assembly of the first support standard and the distal end being removably attached to the second support standard, the sports ball net being suspended from the support line;

wherein the adjustable lower support assembly includes a drive member for driving a slide member, the slide member disposed within a slide member housing, and at least one expansion member operatively connected to the slide member for engaging the corresponding floor support sleeve.

2. The system for supporting a sports ball net according to claim 1, wherein the first and second support standard include a slidably engaged line support mast disposed at an upper portion of each standard for adjusting the height of the sports ball net.

3. The system for supporting a sports ball net according to claim 2, wherein the line support mast includes a locking member for selectively locking the support mast in one position relative to the main body.

4. The system for supporting a sports ball net according to claim 1, wherein the tensioning assembly includes a rotatable drive member for increasing the tension on the support line, the rotatable drive member being disposed substantially internal to the main body.

5. The system for supporting a sports ball net according to claim 1, wherein the drive member of the adjustable lower support assembly is disposed substantially internal to the corresponding main body.

6. The system for supporting a sports ball net according to claim 1, wherein the slide member includes a tapered thrust surface.

7. A standard for supporting a sports ball net, the standard comprising:

a housing having a centerline longitudinal axis;

a net tensioning assembly disposed substantially internal to the housing, the tensioning assembly including a tensioning rod, a drive member engaged with the tensioning rod, and a handle for driving the drive member;

a bottom support portion disposed at a lower end of the housing for rigidly securing the standard to an associated playing surface;

wherein the handle of the net tensioning assembly is disposed along the centerline longitudinal axis of the housing.

8. The standard of claim 7, wherein the standard further includes a line support mast slideably engaged with an upper portion of the housing, the support mast having a locking member for rigidly securing the support mast to the housing.

9. The standard of claim 7, wherein the tensioning rod and the drive member are threadably engaged.

10. The standard of claim 7, wherein the tensioning assembly is gear driven.

11. The standard of claim 7, wherein the net tensioning assembly is disposed substantially internal to the housing of the standard.

12. The standard of claim 7, wherein the handle of the net tensioning assembly is disposed substantially internal to the housing of the standard.

13. The standard of claim 7, wherein the handle of the net tensioning assembly is disposed about an outer circumference of the housing of the standard.

14. The standard of claim 7, further including at least one transport handle or strap attached to the housing.

15. A standard for supporting a sports ball net, the standard comprising:

a housing;

an adjustable floor support assembly, the assembly being disposed at a lower portion of the housing, wherein the assembly includes a drive member for driving at least one slide member, the at least one slide member disposed internally to a slide member housing, the slide member housing being secured to the housing of the standard, and at least one expansion member operatively connected to the at least one slide member, the at least one expansion member adapted to engage an inner wall of a floor support sleeve.

16. The standard of claim 15, wherein the standard further includes a line support mast.

17. The standard of claim 16, wherein the line support mast is slideably engaged with an upper portion of the housing, the support mast having a locking member for rigidly securing the support mast to the housing.

18. The standard of claim 15, wherein the drive member and the at least one slide member are threadably engaged.

19. The standard of claim 15, wherein the adjustable floor support assembly is disposed substantially internal to the housing of the standard.

20. The standard of claim 15, wherein the adjustable floor support assembly further includes a handle operatively connected to the drive member.

21. The standard of claim 20, wherein the handle is disposed about an outer circumference of the housing of the standard.

22. The standard of claim 15, wherein the handle is disposed substantially internal to the housing of the standard.

23. The standard of claim 15, wherein the at least one slide member includes at least one tapered thrust surface for operatively urging the expansion member in an outward radial direction.

24. The standard of claim 15, further including at least one transport handle or strap attached to the housing.

25. The standard of claim 15, wherein a cross section of the housing is at least one of elliptical, circular, rectangular, trilobed.

* * * * *